United States Patent [19]

Ganssle

[11] 4,392,336

[45] Jul. 12, 1983

[54] DRYWALL CONSTRUCTION AND ARTICLE OF MANUFACTURE THEREFOR

[76] Inventor: Jack L. Ganssle, 29567 Fountainwood, Agoura Hills, Calif. 91301

[21] Appl. No.: 243,611

[22] Filed: Mar. 13, 1981

[51] Int. Cl.[3] ..... E04B 2/00

[52] U.S. Cl. ..... 52/417; 52/317

[58] Field of Search ..... 52/417, 317, 696, 347

[56] References Cited

U.S. PATENT DOCUMENTS

| | | | |
|---|---|---|---|
| 1,672,099 | 6/1928 | Schumacher | 428/119 |
| 1,737,413 | 11/1929 | Erola | 428/157 |
| 1,967,846 | 7/1934 | Utzman | 52/347 |
| 2,655,878 | 10/1953 | Clements | 52/11 |
| 4,237,669 | 12/1980 | Hunter | 52/417 |

*Primary Examiner*—James L. Ridgill, Jr.

*Attorney, Agent, or Firm*—I. Morley Drucker

[57] ABSTRACT

A method and means of improved drywall or wallboard construction is shown and described wherein the edges of adjacent wallboards are first mounted to a series of vertically spaced strap members affixed between, and spanning, adjacent typical wall stud or ceiling stud members. The strap members are each provided with a centrally located recessed area. The wallboard edges are then screwed into the recessed area of each of the strap members to form a recessed butt joint which can then be rendered flush by conventional means.

The method and means of the invention permits the bending of wall board and forming of a recessed butt joint without setting up high stresses in the wallboard. Any stresses are adequately offset by the strap member which is substantially rigid, and reinforced, as well, in its central recessed area.

1 Claim, 5 Drawing Figures

Fig. 1
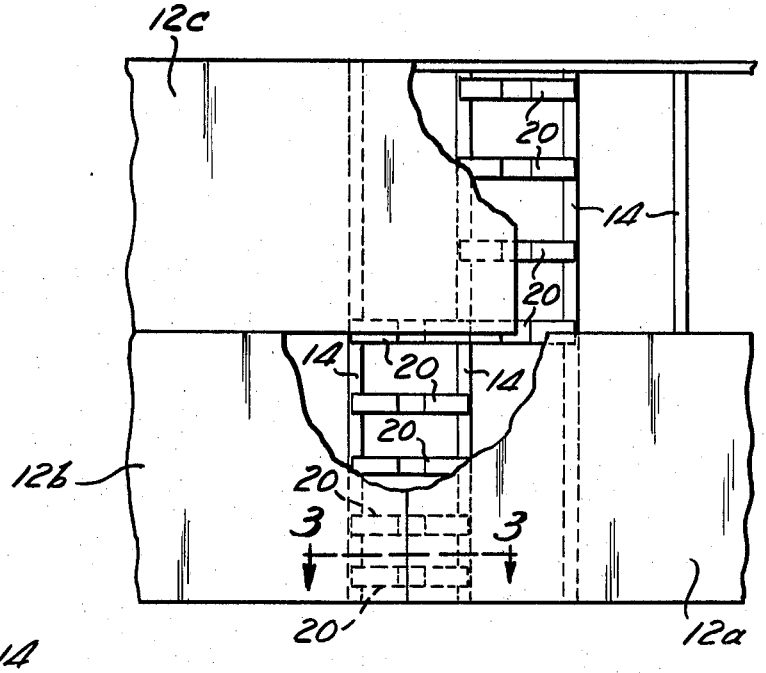
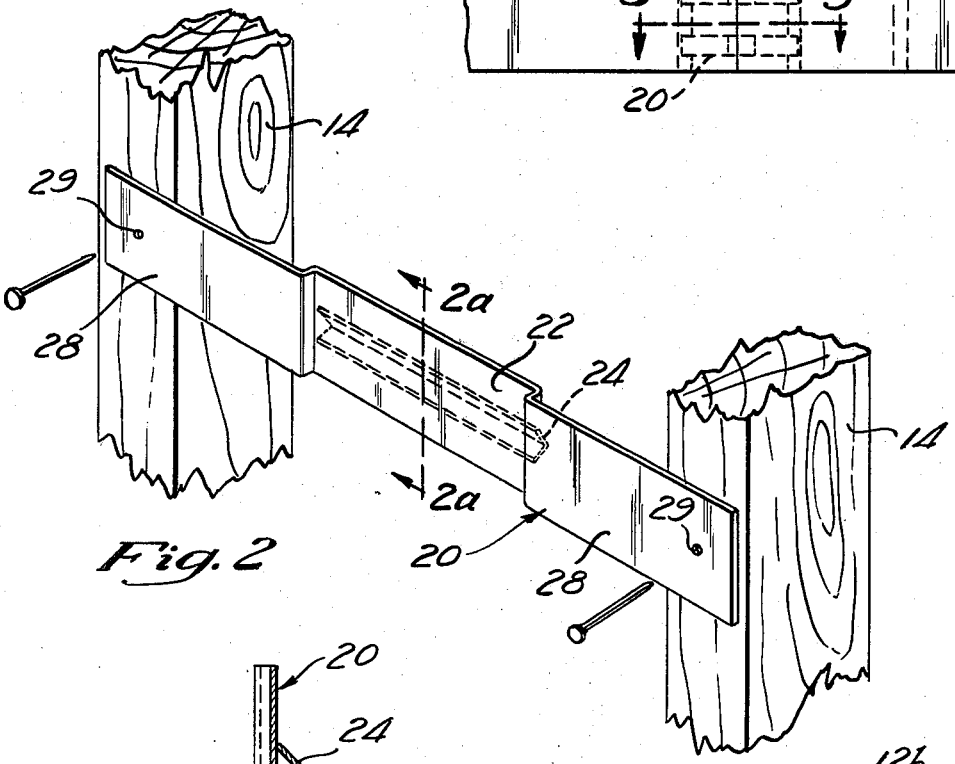
Fig. 2
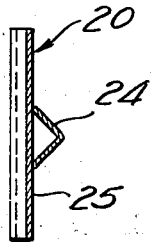
Fig. 2a
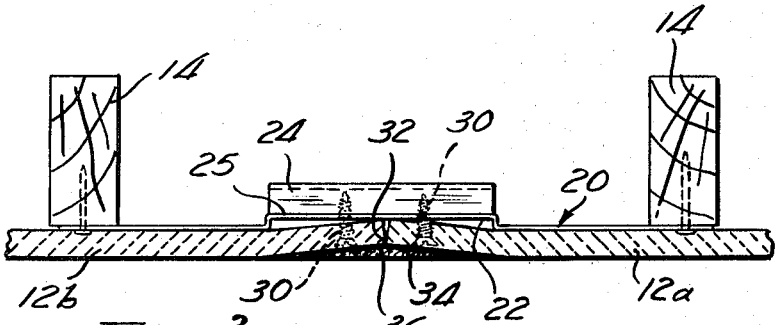
Fig. 3
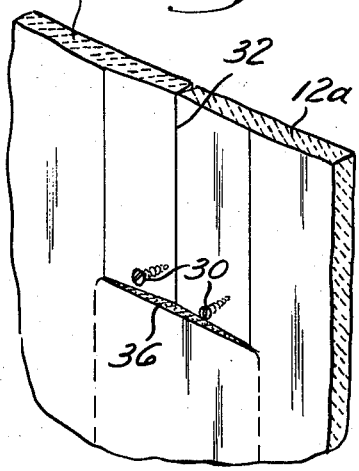
Fig. 4

DRYWALL CONSTRUCTION AND ARTICLE OF MANUFACTURE THEREFOR

BRIEF SUMMARY OF THE INVENTION (a) Field of the Invention

This invention relates to a novel and efficient method for producing smooth, flat joints between abutting vertically disposed edges of wallboards used in lieu of lath and plaster for the construction of walls and ceilings in residential, commercial, industrial and office construction.

(b) Background of the Invention

Commercial wallboard generally comprises a thin plaster or gypsum planar core with a heavy paper covering surrounding the core. The core may be made of various other materials as well, may be encased in compressed wood fibrous material, as well as paper. Wallboard is and has been widely used as a substitute for lath and plaster.

Wallboard is generally installed by nailing the edges thereof to supports, known generally as studs (made of metal or wood), and then papering, painting, or otherwise decorating the same, as with lath and plaster.

One of the major problems in employing the wallboard type of construction is that the joints at the adjacent abutting edges of any two wall boards must be rendered as smooth as possible, and to that end, the joint is usually taped and then coated, as well, with a plastic material. The resultant joint is slightly outwardly bowed with respect to the plane of the surrounding wallboard material, and the net result may be a visually noticeably wavy wall, in those cases where extreme care is not taken to produce a very smooth joint.

(c) Prior Art Statement Pursuant to 37 CFR 1.97

Efforts to alleviate the foregoing noted problems are known in the art. The closest prior art of which I am aware is the Utzman U.S. Pat. No. 1,967,846 issued July 24, 1934 and entitled "Wall Construction". Utzman discloses a means for making an improved butt joint for drywall construction wherein (in FIG. 4) a metal member is first tacked to a supporting stud. The metal member is provided with a flat rear surface and a depressed front surface. The butt ends of adjacent wallboards are tightly nailed to the depressed front surface of the metal member and the resulting recessed joint area is leveled by a finishing material such as Spackle[1] or some other quick-drying, low-shrinkage plastic paste. In the Utzman construction, the abutting edges of each panel must of necessity be sharply inwardly bent and stresses at the joint may thus be quite large.

[1]trademark for a finishing material

The following patents teach other constructions of interest to facilitate a smooth butt joint between wallboard panels:

| PATENTEE | U.S. PAT. NO. | ISSUED |
|---|---|---|
| Clements | 2,655,878 | 10/20/53 |
| Schumacher | 1,672,099 | 6/5/28 |
| Erola | 1,737,413 | 11/26/29 |

The Clements structure is similar to that of one embodiment of Utzman wherein the stud itself is contoured to provide a recessed front surface, and the wallboard edge is nailed directly to the recessed front surface of the stud. The Schumacher and Erola patents rely on the notching of the edges of the wallboard material to facilitate inward bending and making of a smooth butt joint.

However, none of the foregoing prior art teachings provide an inexpensive and efficient solution to the problem of producing a smooth, flat, minimum-stress butt joint between adjacent wallboards.

BRIEF SUMMARY OF THE INVENTION

The invention herein comprises the use of especially reinforced, preferably metal, elongated mounting straps which are affixed to, and span between adjacent studs. By way of example, the mounting straps are approximately 17 inches in overall length for 16 inch center-to-center stud spacing, and are stamped out so as to have a centrally recessed portion of about 5 to 9 inches in length. The ends of the mounting straps are usually nailed to adjacent studs where the joint is to be made. The straps are preferably spaced about one foot apart, measured in a vertical direction. In assembly each of the butt ends of adjacent wallboard sheets are then screwed into the central recessed portions of each of the mounting straps. The butt ends of the sheets are thereby held inwardly with respect to the major planar surface of the wallboard. The butt ends are then taped and finish material applied until the butt joint area is level with respect to the major planar surface of the wallboard.

The mounting straps are preferably reinforced in their central recessed portion, as by being corrugated, by beading, or by welding of reinforcing metallic material, in order to resist pulling forces generated by the wallboard panels tendency to flex outwardly, i.e., to unbend.

The butt joint construction is improved over that type exemplified by Utzman in that the wallboard may be bent inwardly over a much greater radius, the more gradual curvature resulting in less stresses being produced in the wallboard, which, in turn, results in a more stable and secure joint.

BRIEF DESCRIPTION OF THE DRAWINGS

FIG. 1 is a partially broken away, view of wallboard panels mounted to a typical stud wall in accordance with the construction of my invention;

FIG. 2 is an enlarged fragmentary perspective showing my novel strap member to be mounted between studs of a typical stud wall;

FIG. 2*a* is an x-section taken along the line 2a—2a of FIG. 2.

FIG. 3 is a transverse x-section, taken along the line 3—3 of FIG. 1; and FIG. 4 is a fragmentary perspective of the recessed butt joint formed by means of this invention with the leveling filler material shown in dotted line.

DETAILED DESCRIPTION OF THE INVENTION

The best mode presently contemplated of utilizing the invention is shown and described in the drawings. Referring expecially to FIG. 1, wallboard panels 12*a*, 12*b* and 12*c* each typically 4' wide in one dimension, and of the longest possible length (depending, of course, on the length of the wall to be covered) to minimize the number of joints, are shown positioned on a stud wall in staggered fashion. The vertical studs 14 are typically 16" o.c. (on center) and are usually made of wood or metal, though wood studs are shown in the drawings.

Spanning between, and affixed to, adjacent studs 14 are a plurality of vertically spaced substantially rigid, unitary metal strap members 20. The strap members 20 are preferably made of 22 gauge galvanized iron or other metal.

Referring now in particular to FIGS. 2 and 3, each strap member 20 is provided with a centrally located recessed area or portion 22, reinforced or stiffened by a metal angle member 24 welded or otherwise affixed, to the rear face 25 of the recessed area 22. The recessed area 22 is recessed about 1/16" - 3/16" inwardly with respect to the outer ends 28 of the strap member 20, the outer ends 28 being coplanar. Nail or screw holes 29 are pre-drilled or tapped at the extremes of the outer ends 28.

The strap members 20 have an overall length of approximately 17" if a 16" o.c. spacing between studs is to be spanned. The length of the recessed area 22 of each strap member 20 is preferably about 6", in length, although the length of the recessed area may have a range of between about 5" to 9". If 24" o.c. stud spacing is to be spanned, the strap members 20 have a length of about 25". The width of the strap members 20 is preferably about 1½" and each strap member is vertically spaced at about 12" o.c. from its adjacent strap member as best shown in FIG. 1.

Turning now to the method of installation of the wallboard panels, a series of strap members 20 are nailed to adjacent wood studs 14 (or screwed into metal studs, not shown). Preferably strap members 20 are nailed in a series of four in the lower four feet of a pair of studs, and then another series of four strap members 20 positioned approximately 16", measured horizontally, from the first series of strap members 20. The recessed areas 22 of each strap member in each series of four are in generally vertical alignment.

Wallboard panels 12*a*, 12*b* are typically 4' in the width dimension, and are preferably mounted in staggered fashion, as shown in FIG. 1, so that a series of staggered 4' long butt joints are constructed. The butt joints are staggered by about 16" minimum. Specifically, the edges of adjacent wallboard panels 12*a*, 12*b* are placed in abutment within the recessed, reinforced, strap areas 22 of the strap members 20; the abutting edges are then screwed into the recessed areas 22, by self-tapping screws 30 to thereby form a recessed butt joint 32 with respect to the major plane surface of the wallboard panels 12*a*, 12*b*. The butt joint 32 is then taped, by conventional building adhesive taping material 34. The recessed butt joint 32 is then brought to a flush condition with respect to the major planar surface of wallboard panels 12*a*, 12*b* by means of a plastic resin paste or other quick-drying filler or "bedding" material 36.

While the edges of wallboard panels 12*a*, 12*b* forming joint 32 are bent inwardly, the inward curvature is relatively slight thereby minimizing the outwardly pulling or tensile forces set up by the wallboard panels. Any such outward pulling forces are adequately and completely resisted by the reinforced central areas 22 of each of the strap members 20.

I claim:

1. An article of manufacture, for use in molding wallboard panels between studs, which comprises: an elongated substantially rigid unitary strap member having elongated end portions which are substantially co-planar with respect to each other, an elongated recessed portion centrally located between said end portions, said elongated co-planar end portions extending inwardly of said studs for a substantial distance and said elongated recessed portion therebetween extending for a distance of about 5–9 inches in length, and substantially less than the distance between studs, predrilled openings defined within the ends of each of said elongated co-planar end portions, and a stiffener means affixed to said elongated recessed portion to resist pulling forces on said strap member.

* * * * *